US010640320B2

(12) United States Patent
Matheny

(10) Patent No.: US 10,640,320 B2
(45) Date of Patent: May 5, 2020

(54) BELT MOUNTED FOLDING TAPE HOLDER

(71) Applicant: David H. Matheny, Vancouver, WA (US)

(72) Inventor: David H. Matheny, Vancouver, WA (US)

( * ) Notice: Subject to any disclaimer, the term of this patent is extended or adjusted under 35 U.S.C. 154(b) by 196 days.

(21) Appl. No.: 15/964,562

(22) Filed: Apr. 27, 2018

(65) Prior Publication Data

US 2018/0319615 A1 Nov. 8, 2018

Related U.S. Application Data

(60) Provisional application No. 62/500,251, filed on May 2, 2017.

(51) Int. Cl.

| | |
|---|---|
| ***B65H 35/00*** | (2006.01) |
| ***A45F 5/02*** | (2006.01) |
| ***B65H 16/04*** | (2006.01) |

(52) U.S. Cl.

CPC ..... *B65H 35/0026* (2013.01); *A45F 5/021* (2013.01); *B65H 16/04* (2013.01); *B65H 2402/413* (2013.01)

(58) Field of Classification Search

CPC ..... B65H 35/0026; B65H 2402/413; B65H 16/04; A45F 5/02; A45F 5/021; A45F 2005/027; A45F 2200/0575

See application file for complete search history.

(56) References Cited

U.S. PATENT DOCUMENTS

| | | | | |
|---|---|---|---|---|
| 2,525,992 | A | 10/1950 | Wynn | |
| 2,526,768 | A * | 10/1950 | Pendergrass | F41C 33/007 224/182 |
| 2,924,365 | A * | 2/1960 | Dahlquist | B65H 35/0026 225/47 |
| 3,249,319 | A * | 5/1966 | Wasson | E04G 21/122 242/588.1 |
| 4,277,035 | A * | 7/1981 | Gaski | H02G 11/02 242/129 |
| 4,358,036 | A | 11/1982 | Maltais | |
| 4,569,466 | A | 2/1986 | Webber | |
| D306,521 | S | 3/1990 | Kenney | |
| D317,984 | S | 7/1991 | Reynoso et al. | |
| 5,248,072 | A | 9/1993 | Jones | |
| 6,508,390 | B1 * | 1/2003 | Karpati | A45F 5/00 224/200 |
| 7,175,061 | B2 * | 2/2007 | Dohn | A45F 5/02 224/241 |
| 8,485,406 | B2 * | 7/2013 | Huh | A45F 5/021 224/241 |

(Continued)

*Primary Examiner* — William A. Rivera

(74) *Attorney, Agent, or Firm* — Bretton L. Crockett; TechLaw Ventures, PLLC

(57) ABSTRACT

Belt mounted folding tape holders and related methods and systems. In a first illustrative embodiment, a tape holder assembly has a body with a belt clip disposed on a first side, on the opposite side, a folding hook may be stored in a recess when not in use to provide a slim profile. For use, the folding hook is released from the recess and folded down to provide a generally horizontal shelf on which one or more rolls of tape may be placed. A generally vertical member is disposed at a distal end of the shelf to retain the tape roll thereon. In some embodiments, the vertical member may fold and in others it may be fixed to the end of the shelf member.

21 Claims, 4 Drawing Sheets

(56) References Cited

U.S. PATENT DOCUMENTS

| | | | | |
|---|---|---|---|---|
| D718,929 | S * | 12/2014 | Knez | D3/220 |
| 2003/0160075 | A1* | 8/2003 | Musarella | A45F 5/02 224/269 |
| 2004/0045992 | A1* | 3/2004 | Dohn | A45F 5/02 224/673 |
| 2009/0206098 | A1* | 8/2009 | Garahan | A45F 5/02 220/737 |
| 2013/0146624 | A1 | 6/2013 | Soria | |

* cited by examiner

BELT MOUNTED FOLDING TAPE HOLDER

CROSS-REFERENCE TO RELATED APPLICATION

This application claims the benefit of U.S. Provisional Application No. 65/500,251, filed May 2, 2017, the disclosure of which is incorporated herein by reference in its entirety.

TECHNICAL FIELD

The present disclosure relates to a belt mounted holder for rolls of adhesive tape.

BACKGROUND

One issue with working with various hand tools and supplies is the need for placement in a location that provides ready access when needed, but does not require a user to hold them when doing other tasks. Belt mounted holders for tools are typically designed for use with only a single type of tool, such as a hammer or a specialty tool. Such hooks can be bulky for use with a tool belt and may inadvertently catch on things around a user, especially when not currently in use. Similarly, belt mounted tape dispensers include a number of features for cutting or stretching tape, which make them bulky and sometimes inconvenient for certain applications, such as tape masking for painting.

A system or device that has a slim profile, can be used with a standard belt, rather than a specialized tool belt, and provided a hands free convenient holder for rolls of tape would be an improvement in the art.

SUMMARY

The present disclosure is directed to belt mounted folding tape holders and to related methods and systems. In a first illustrative embodiment, a tape holder assembly has a body with a belt clip disposed on a first side, on the opposite side, a folding hook may be stored in a recess when not in use to provide a slim profile, for use, the folding hook is released from the recess and folded down to provide a generally horizontal shelf on which one or more rolls of tape may be placed. A generally vertical member is disposed at a distal end of the shelf to retain the tape roll thereon. In some embodiments, the vertical member may fold and in others it may be fixed to the end of the shelf member.

DESCRIPTION OF THE DRAWINGS

It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, to the several drawings, and to the attached Appendix.

DETAILED DESCRIPTION

It will be appreciated by those skilled in the art that the embodiments herein described, while illustrative, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure.

Figure 1:
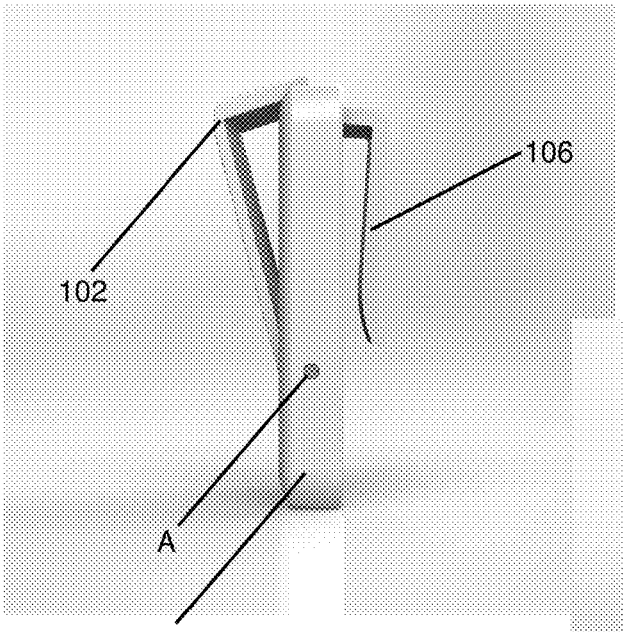
FIG. 1 is a side view of a first embodiment of a belt mounted folding tape holder in accordance with the present disclosure.
Figure 2:
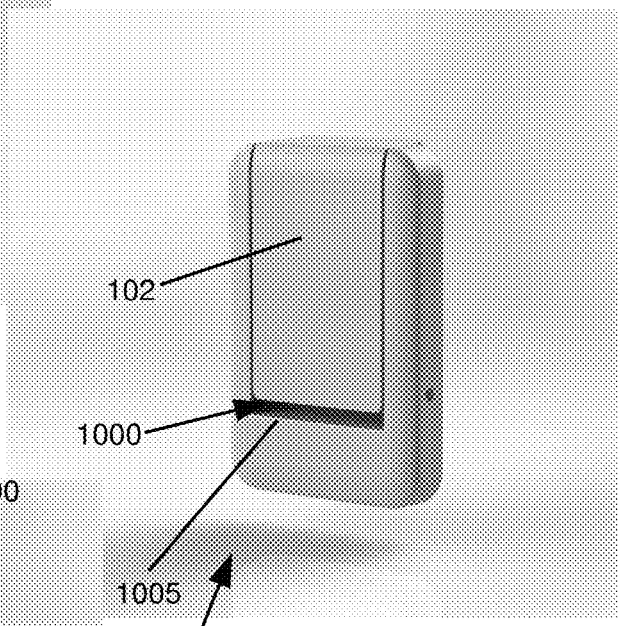
FIG. 2 is a front perspective view of the embodiment of FIG. 1, in a closed position.
Figure 3:
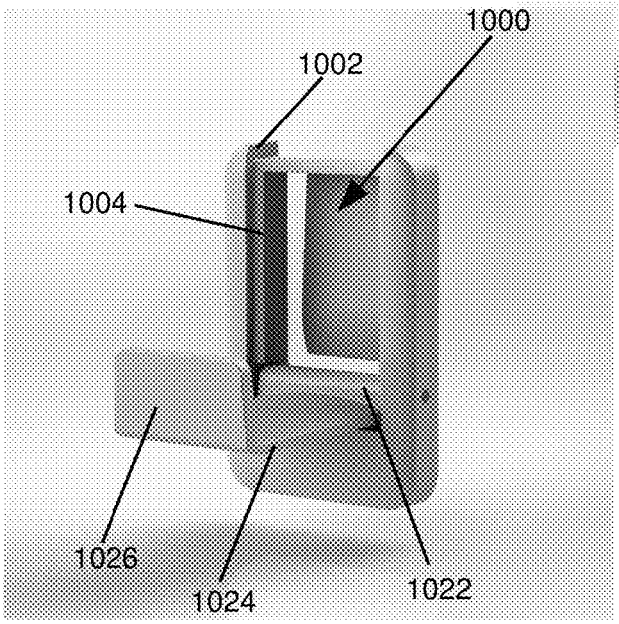
FIG. 3 is a front perspective view of the embodiment of FIGS. 1 and 2, in a deployed position.

Turning to FIGS. 1, 2 and 3, a first embodiment of a belt mounted tape holder 10 is depicted. In this first illustrative embodiment, the tape holder assembly 10 has a body 100 to which the other components are attached. The body 100 may be formed as a generally rectangular block, with top, bottom, front back and left and right sides, although it will be appreciated that other shapes may be used. A belt clip 106 may be disposed on the back side. In the depicted embodiment, the belt clip 106 is formed as an elongated member that extends outwards from near the upper portion of the body 100 for a first distance and then downwards in a direction generally parallel to the body 100. As depicted, the downwards extending portion may be curved towards and away from the body 100 to facilitate placement on the belt of a wearer and securement thereon. The back surface of the body 100 may be recessed to more securely fit when worn on the curved portion of a user's hip.

The front and top surface of the body 100 may include a recess 1000 for receiving the folding hook 102, as discussed in further detail below. In the depicted embodiment, this recess 1000 has an internal sidewall 1002 leading to an internal ridge 1004 to define a space for the folding hook 102 to reside in an undeployed position. The internal ridge may be generally U-shaped along the recess 1000 and along the top surface, the internal ridge 1004 may define a bridge. At a lower end, the recess is bounded by a lower wall 1005 which is spaced down from a lower end of the internal ridge 1004.

Folding hook 102 has a first end that may define a tube 1022. In the depicted embodiment, the tube 1022 resides in the recess 1000 in the space below the lower end of internal ridge 1004. An axle member A passes through the body and resided in the tube 1022, allowing the hook 102 to rotate thereon. It will be appreciated that in other embodiments, differing hinge structures may be used.

Extending distally from tube 1022, the folding hook 102 has a first elongated portion 1024 which provides a generally horizontal shelf when deployed. This first portion 1024 may be generally planar or may have a planar outer surface and curved inner surface to conform to the curve of a roll of tape. The first portion 1024 will have a sufficient length to allow one or more rolls of tape to be placed thereon. At a distal end of the first portion 1024, a second portion 1026 is disposed. Second portion 1026 is generally orthogonal to first portion 1024 and positioned to extend generally vertically upwards therefrom, when in a deployed position, to help retain tape rolls thereon.

The folding hook may be deployed by rotating downwards from the body with the outer surface of the lower portion 1024 of folding hook 102 residing and supported by the lower wall 1005. When not in use, the folding hook 102 may be stowed by rotating upwards until it resides in recess 1000. The back surface of lower portion 1024 may reside at or near the internal ridge 1004. In the depicted embodiment, the inner surface of second portion 1026 and the upper portion of the bridge formed by 1004 may include structures, such as a tab and corresponding recess for securing the folding hook in place. Upon closing, the outer surface of the folding hook 102 may be coplanar with the body surface to provide a smooth profile.

Figure 4:
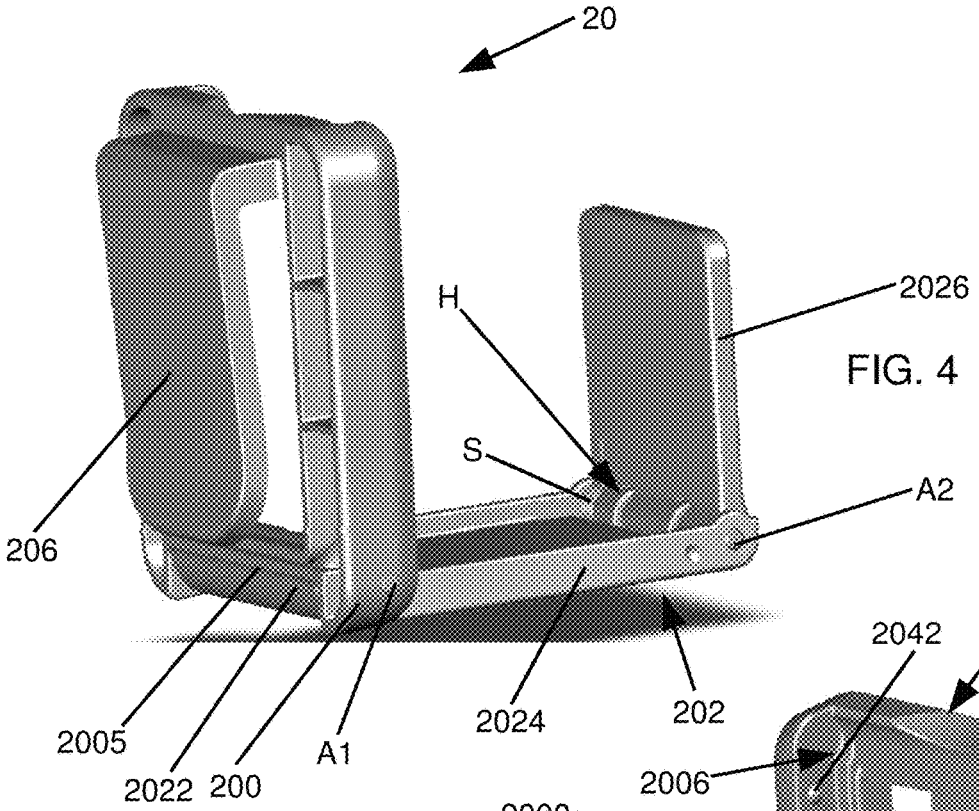
FIG. 4 is a side perspective view of a second embodiment of a belt mounted folding tape holder in accordance with the present disclosure.
Figure 5:
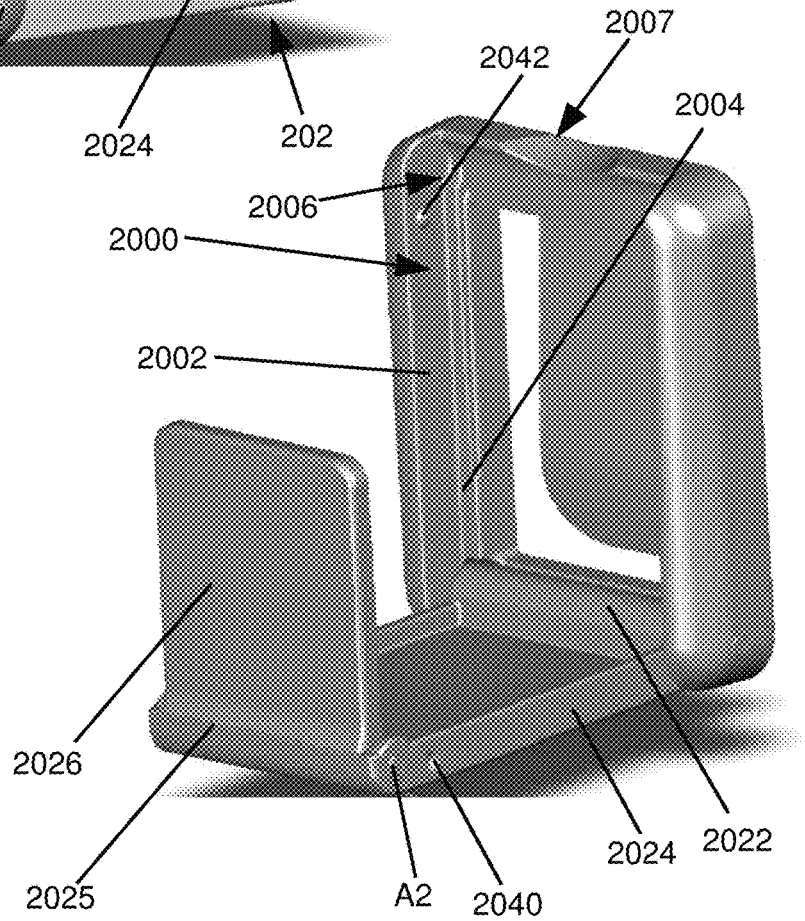
FIG. 5 is a front side perspective view of the embodiment of FIG. 4.
Figure 6:
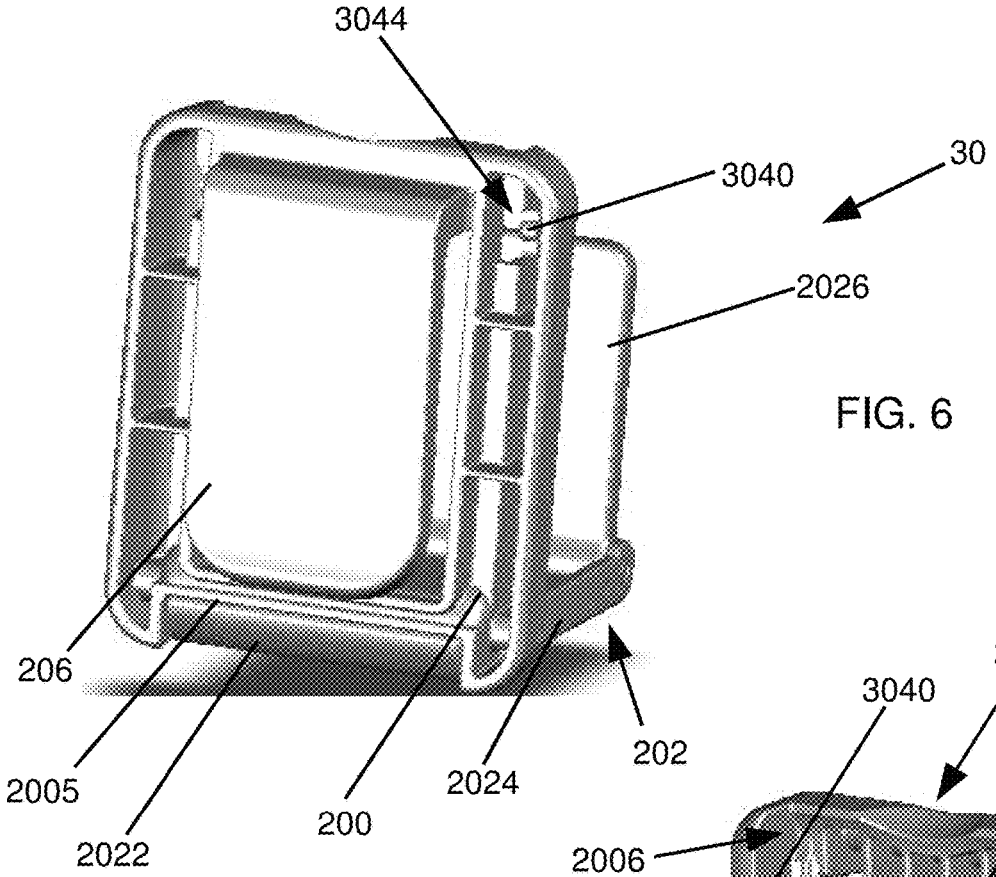
FIG. 6 is a rear side perspective view of a second embodiment of a belt mounted folding tape holder in accordance with the present disclosure.
Figure 7:
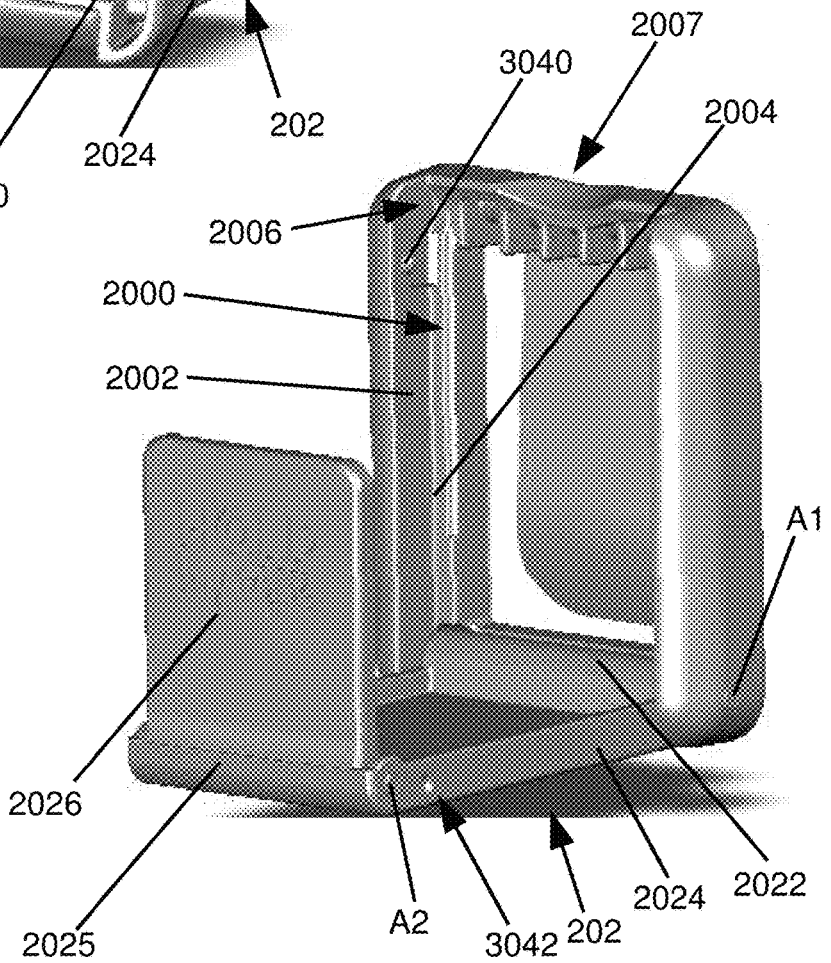
FIG. 7 is a front side perspective view of the embodiment of FIG. 6.

Turning to FIGS. 4 and 5, a second embodiment of a belt mounted tape holder 20 is depicted. In this illustrative embodiment, the tape holder assembly 20 has a body 200 to which the other components are attached. The body 200 may be formed as a generally rectangular block, with top, bottom, front back and left and right sides, although it will be appreciated that other shapes may be used. A belt clip 206 may be disposed on the back side. In the depicted embodiment, the belt clip 206 is formed as an elongated member that extends outwards from near the upper portion of the body 200 for a first distance and then downwards in a direction generally parallel to the body 200. As depicted, the downwards extending portion may be curved towards and away from the body 200 to facilitate placement on the belt of a wearer and securement thereon. The back surface of the body 200 may be generally planar or may be recessed to more securely fit when worn on the curved portion of a user's hip.

The front and top surface of the body 200 may include a recess 2000 for receiving the folding hook 202, as discussed in further detail below. In the depicted embodiment, this recess 2000 has an internal sidewall 2002 leading to an internal ridge 2004 to define a space for the folding hook 202 to reside in an undeployed position. The internal ridge may generally run parallel along the recess 2000 and along the top surface may include a curved recess 2006 therein. At a lower end, the recess 2000 may be open to the end of the body 200 and may include a bounding wall 2005 connected to the internal ridge 2004 and spaced upwards form the lower end of body 200.

At a top end, the body 200 may include a small concave area 2007 leading to the recess 2000.

Folding hook 202 has a first end that may define a tube 2022. In the depicted embodiment, the tube 2022 resides in the recess 2000 in the space below the lower end of internal ridge 2004. An axle member A1 passes through the body and resides in the tube 2022, allowing the hook 202 to rotate thereon. It will be appreciated that in other embodiments, differing hinge structures may be used.

Extending distally from tube 2022, the folding hook 202 has a first elongated portion 2024 which provides a generally horizontal shelf when deployed. This first portion 2024 may be generally planar or may have a planar outer surface and an inset inner surface with two sidewalls. The first portion 2024 will have a sufficient length to allow one or more rolls of tape to be placed thereon.

At a distal end of the first portion 2024, a second portion 2026 is rotationally attached thereto, such that when deployed, the second portion 2026 is generally orthogonal to first portion 2024 and positioned to extend generally vertically upwards therefrom to help retain tape rolls thereon. In the depicted embodiment, a hinge structure H connects the first portion 2024 and second portion 2026. The hinge structure H may be formed by counterpart tubular members on the distal end of the first portion 2024 and the proximal end of the second portion 2026 that align so that the bores thereof similarly align. An axle member A2 resides in the aligned bores and allows rotation of the members therearound. Parallel planar walls, such as wall 2025 on the members may meet to prevent over-rotation. A spring S may be used to provide force to maintain the second portion 2024 in the upright deployed position.

The folding hook may be deployed by rotating downwards from the body 200. From the closed undeployed position, a user may place a thumb or finger in the concave area 2007, against the edge of the hook 202 and push it outward to begin the downwards rotation. The folding hook 202 then rotates downwards until reaching a deployed position with the outer surface of the lower portion 2024 of folding hook 202 residing below and abutting lower wall 2005 to prevent further rotation. The second portion 2026 is similarly urged by spring S to rotate upwards for deployment. When not in use, the folding hook 202 may be stowed by rotating the second portion 2026 downwards to the first portion 2024 (which may at least partially reside in the recess thereof where present), and then rotate the hook 202 upwards until it resides in recess 2000. The back surface of lower portion 2024 may reside at or near the internal ridge 2004. The hinge structure H may reside in the recess 2006 formed in the internal ridge 2004 to receive it. In the depicted embodiment, the side surfaces of the first portion 2026 and the internal sidewall 2002 of the recess 2000 may include structures, such as a tab 2040 and corresponding recess 2042 for securing the folding hook in place. Upon closing, the outer surface of the folding hook 202 may be coplanar with the body surface to provide a smooth profile.

In the depicted embodiment of FIGS. 4 and 5, tabs 2040 are disposed on the outer sidewalls of the lower portion 2024. Turning to FIGS. 6 through 10, another embodiment of a belt mounted tape holder 30 in accordance with the present disclosure is depicted. As with holder 20 depicted in FIGS. 4 and 5, assembly 30 is a belt mounted tape holder with a folding hook 202 having a first portion 2024 and a rotationally attached second portion 2026. Similar features of holder 30 are designated with like reference numerals including body 200, belt clip 206, recess 2000 with internal sidewall 2002 and internal ridge 2004. Body 200 may similarly include a small concave area 2007 leading to the recess 2000.

Holder 30 differs from holder 20 with respect to the structures for securing the folding hook 202 in recess 2000. As depicted embodiment, the side surfaces of the first portion 2024 may include a small recess or dimple 3042 that is disposed on its external sidewall. A larger tab recess 3044 disposed in the sidewall 2002 of recess 2000 contains a tab 3040 which may be attached to the front sidewall of the tab recess 3044 for securing the folding hook in place, with the rear side of the tab having a rounded surface over the tab recess. As the hook 202 is folded into the body 200, upper surface of the tab 3040, which may be rounded, moves into the dimple 3042. The hook 202 is retained in the recess 200 by the frictional fit between the tab 3040 and the dimple 3042 surface. It will be appreciated that use of plastic materials can provide some flexibility to the structures to allow the movement of the tab into the locking dimple. The use of a tab 3040 formed adjacent to the sidewall of a recess may allow for additional movement when securing or releasing It will be further appreciated that the use of multiple locking tabs 3040 and counterpart dimples 3042, for example the two depicted that are disposed on either side of the first portion 2024 may result in a more secure fit. Additionally, by having only dimples 3042 exposed on the hook and the tabs 3040 placed within recesses in the body 200, the potential for damage to the securing structures during use may be reduced. Upon closing, the outer surface of the folding hook 202 may be coplanar with the body surface to provide a smooth profile.

Figure 8:
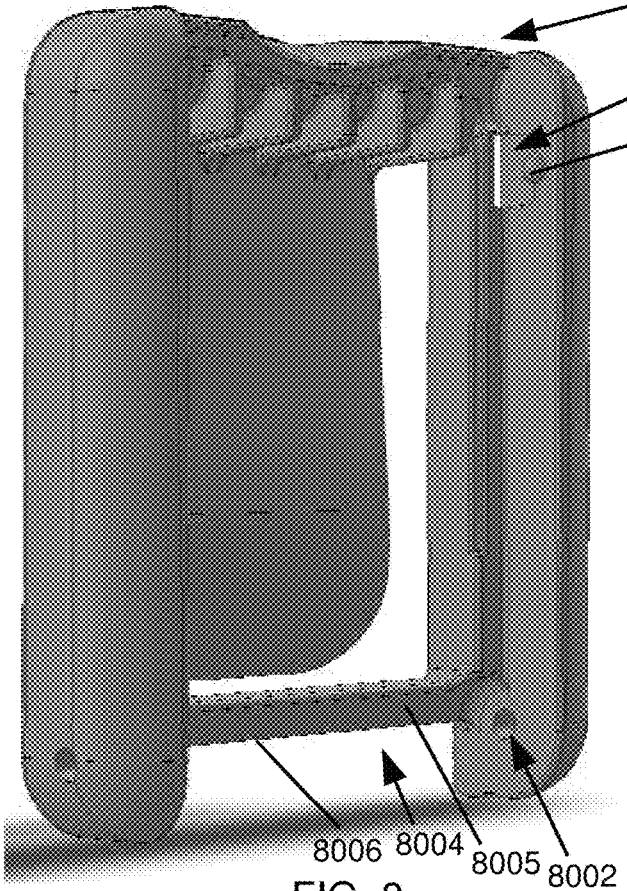
FIG. 8 is a front side perspective view of the body of the embodiment of FIGS. 6 and 7 in isolation.

FIG. 8 depicts body 200 in isolation, allowing additional structural details to be visible. As depicted in FIG. 8, at a lower end of body 200, the recess 2000 continues to an open bottom, which is bounded on either side by the sides 2002 of the recess. Axle holes 8002 may be disposed through the sides 2002 to allow the installation of axle A1. An internal cross member 8004 may span the recess 200 and have a front surface parallel the internal ridge 2004, and a bottom surface 8005 that is curved to match the hinge 1004 of the first portion 2024 in a front section with a planar back bottom wall 8006.

Figure 9:
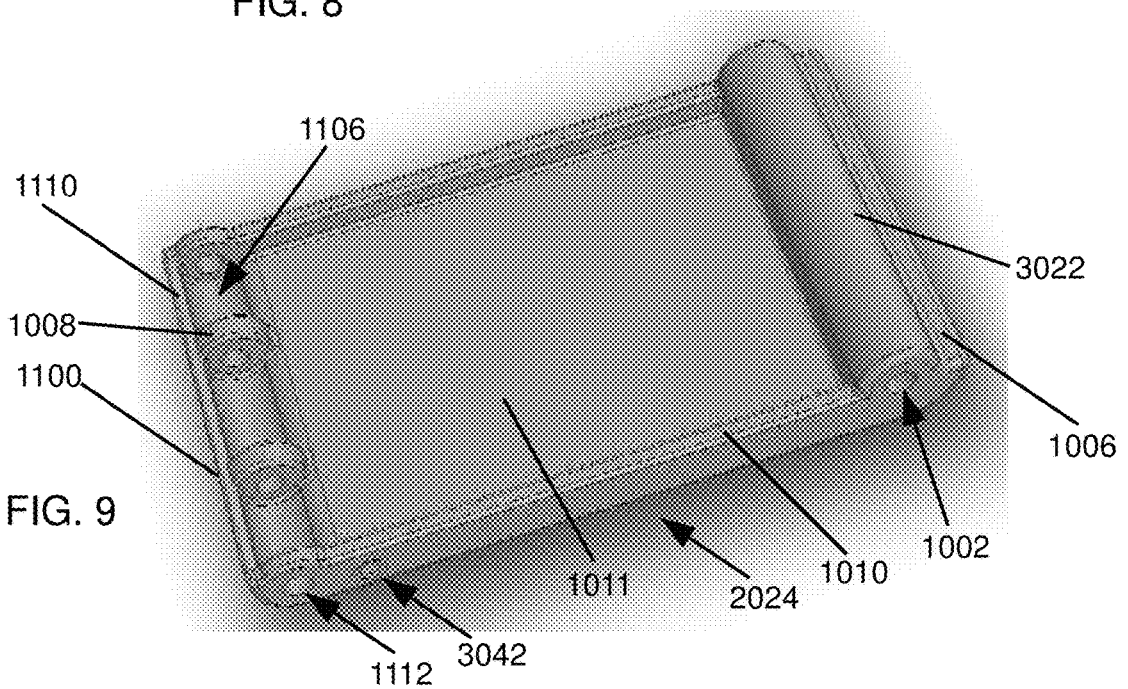
FIG. 9 is a front side perspective view of the second member of the folding hook of the embodiment of FIGS. 6 and 7 in isolation.

FIG. 9 depicts the first or lower portion 202 and shows the tube 3022 near first end that holds axle A1 in its bore 1002 and curves to match bottom surface 8005. Between tube 3022 and the first end 1000, a generally planar surface 1006 may be disposed. On actuation, first portion 202 is rotated downwards until the planar surface 1006 and planar back bottom wall 8006 contact one another, ending the rotation and providing support for the deployed "hook."

At the distal or second end 1100 of the first portion 2024, the structure of hinge H may be seen. As depicted, a 1106 recess formed as a half tube contains one or more counterpart tubular members 1008, each formed as a "disc" having a central hole for passage of axle A2. At either side of the lower portion 2024, the edge wall 1010 of the portion may be similarly shaped and include a hole 1112 for the insertion of the axle A2. A generally planar surface 1110 may be disposed distal to the recess 1106. Additionally, a central planar surface 1011 between the two edge walls may be recessed to allow the second portion 2024 to reside therein in the undeployed position, as when folded for storage.

Figure 10:
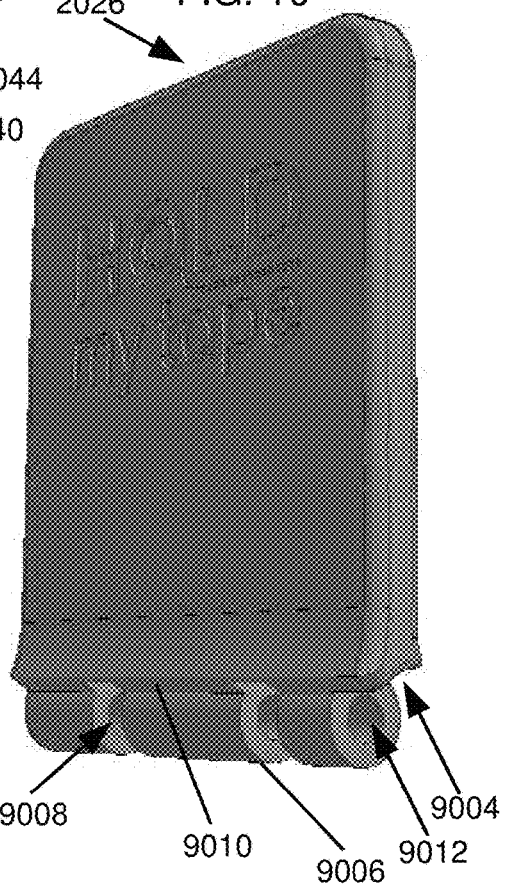
FIG. 10 is a top perspective view of the first member of the folding hook of the embodiment of FIGS. 6 and 7 in isolation.

FIG. 10 depicts the second portion 2026 in isolation. At a lower end, counterpart tubular members 9006 that are sized and shaped to correspond to recess 1106 are disposed. Spaces 9008 between the tubular members 9006 correspond to the counterpart tubular member 1008, allowing for insertion into the recess with the bores 9012 and 1112 aligned. A curved lower surface 9004 disposed above the members 9006 may correspond to the counterpart members. A lower planar surface 9010 below the front face of the member 2026 may abut planar surface 1110 to stop the rotation on actuation.

The assemblies depicted herein may be constructed from any suitable materials. It will be appreciated that the use of injection molded plastics and other polymers for certain components may provide elasticity and resiliency to facilitate the use of locking tabs and recesses as described herein.

In use, the assemblies 10, 20, and 30 may be used for supporting tape rolls for painter or for other purposes. For example, some users doing painting may use the hook 102 or 202 for carrying a rag or towel moistened with water or a suitable solvent for minor cleaning as may be needed. A user could use multiple assemblies, such as one position on either side of the user's body, where advantageous as to keep both hands free when ascending or descending a ladder.

While this disclosure has been described using certain embodiments, it can be further modified while keeping within its spirit and scope. This application is therefore intended to cover any variations, uses, or adaptations of the disclosure using its general principles. Further, this application is intended to cover such departures from the present disclosure as come within known or customary practices in the art to which it pertains and which fall within the limits of the appended claims.

The invention claimed is:

1. A belt mounted tape holder assembly comprising:

a body having a front surface with a recess disposed therein;

a belt clip attached to the body; and a folding hook comprising a shelf portion and a retaining portion, the retaining portion disposed at a distal end of the shelf portion in a generally orthogonal relationship when actuated, and the folding hook rotatably attached to the body, such that at least a portion of the folding hook is disposed in the recess in an unactuated position.

2. The belt mounted tape holder assembly of claim 1, wherein the belt clip comprises a curved member attached to a rear surface of the body near an upper end of the body.

3. The belt mounted tape holder assembly of claim 1, wherein the retaining portion is formed as a generally planar member rotatably attached near the distal end of the shelf member, such that the retaining portion rotates towards the shelf member in the unactuated position.

4. The belt mounted tape holder of claim 3, wherein the retaining portion comprises a generally planar contact surface and the shelf portion has a counterpart contact surface, which abut one another when the folding hook is actuated to stop further rotation of the retaining portion with respect to the shelf portion.

5. The belt mounted tape holder of claim 3, further comprising a spring that urges the retaining portion away from the shelf portion when the folding hook is actuated.

6. The belt mounted tape holder of claim 1, wherein the shelf portion is rotatably attached to the body near a lower end of the body.

7. The belt mounted tape holder of claim 1, wherein the shelf portion comprises a generally planar body contact surface and the body has a counterpart shelf contact surface, which abut one another when the folding hook is actuated to stop further rotation of the shelf portion with respect to the body.

8. The belt mounted tape holder of claim 1, further comprising at least one locking structure disposed on the shelf portion which interacts with a counterpart locking structure disposed on the body when the locking hook is rotated to an undeployed position to retain the locking hook in the undeployed position.

9. The belt mounted tape holder of claim 8, wherein the at least one locking structure disposed on the shelf portion comprises a dimple disposed in a sidewall of the shelf portion and the counterpart locking structure comprises a locking tab disposed on a sidewall of the recess.

10. The belt mounted tape holder of claim 1, wherein the folding hook is rotatably attached to the body by an axle passing through at least a portion of the body and a bore formed in the shelf portion.

11. A folding belt mounted tape holder comprising:

a body having a front surface and a rear surface;

a belt clip attached to the back surface; and a folding hook comprising a shelf member rotatably attached to the body, the shelf member rotated to a position generally parallel to the body when in an undeployed position and rotated to a position generally orthogonal to the body when in a deployed position, and a retaining member rotatably attached to the shelf member, the retaining member rotated to a position generally parallel to the shelf member when in an undeployed position and rotated to a position generally orthogonal to the shelf member when in a deployed position.

12. The belt mounted tape holder of claim 11, wherein the body further comprises a recess accessible from at least the front surface and at least a portion of the folding hook is disposed in the recess in the undeployed position.

13. The belt mounted tape holder of claim 12, further comprising at least one locking structure disposed on the shelf member which interacts with a counterpart locking structure disposed on the body when the locking hook is rotated to the undeployed position to retain the locking hook in the undeployed position.

14. The belt mounted tape holder of claim 13, wherein the at least one locking structure disposed on the shelf portion comprises a dimple disposed in a sidewall of the shelf portion and the counterpart locking structure comprises a locking tab disposed on a sidewall of the recess.

15. The belt mounted tape holder of claim 11, wherein the shelf member has a recessed inner surface and the retaining member is rotated to reside in the recessed inner surface when in the undeployed position.

16. The belt mounted tape holder of claim 11, wherein the retaining member comprises a generally planar contact surface and the shelf member has a counterpart contact surface, which abut one another when the folding hook is deployed to stop further rotation of the retaining member with respect to the shelf member.

17. The belt mounted tape holder of claim 11, further comprising a spring that urges the retaining member away from the shelf member when the folding hook is deployed.

18. The belt mounted tape holder of claim 11, wherein the shelf member is rotatably attached to the body near a lower end of the body.

19. The belt mounted tape holder of claim 11, wherein the shelf member comprises a generally planar body contact surface and the body has a counterpart shelf contact surface, which abut one another when the folding hook is actuated to stop further rotation of the shelf member with respect to the body.

20. The belt mounted tape holder of claim 11, wherein the folding hook is rotatably attached to the body by an axle passing through at least a portion of the body and a bore formed in the shelf member.

21. A belt mounted tape holder assembly comprising:

a body having a front surface with a recess disposed therein;

a belt clip attached to the body; and a folding hook comprising a shelf portion and a retaining portion, the retaining portion disposed at a distal end of the shelf portion when actuated, and the folding hook rotatably attached to the body, such that in an unactuated position the recess is covered by at least a portion of the folding hook.

* * * * *